United States Patent [19]

Matsubara et al.

[11] 4,143,818

[45] Mar. 13, 1979

[54] RAIL FASTENING APPARATUS

[75] Inventors: Kentaro Matsubara; Yoshio Matsuo, both of Tokyo, Japan

[73] Assignee: Tetsudo Kizai Kogyo Company Limited, Tokyo, Japan

[21] Appl. No.: 817,161

[22] Filed: Jul. 20, 1977

[30] Foreign Application Priority Data

Jan. 31, 1977 [JP] Japan ..... 52-009307[U]

[51] Int. Cl.[2] ..... E01B 9/30; E01B 9/34; E01B 9/48

[52] U.S. Cl. ..... 238/349; 238/265; 238/338; 238/341; 238/360

[58] Field of Search ..... 238/265, 317, 341, 349, 238/360, 310, 315, 322, 338, 351

[56] References Cited

U.S. PATENT DOCUMENTS

| | | | |
|---|---|---|---|
| 670,495 | 3/1901 | Harrell | 238/349 X |
| 1,811,016 | 6/1931 | Kumamoto | 238/265 |
| 1,863,039 | 6/1932 | Chandler | 238/322 X |
| 1,998,043 | 4/1935 | Boyd et al. | 238/349 X |
| 2,350,819 | 6/1944 | Retterath | 238/360 |
| 2,638,276 | 5/1953 | Stamm | 238/349 |
| 3,887,128 | 6/1975 | Ruble | 238/349 |

FOREIGN PATENT DOCUMENTS

| | | | |
|---|---|---|---|
| 1031773 | 6/1953 | France | 238/349 |
| 910744 | 11/1962 | United Kingdom | 238/349 |

*Primary Examiner*—Robert G. Sheridan
*Assistant Examiner*—Randolph A. Reese
*Attorney, Agent, or Firm*—Blanchard, Flynn, Thiel, Boutell & Tanis

[57] ABSTRACT

A rail fastening apparatus for cooperation with a rail which is supported on and extends transversely across a tie. The apparatus comprising a steel support positioned adjacent one side of the rail and having a leg portion which is buried in the tie and an upper portion which projects upwardly above the tie. A lever is pivotally supported on the upper portion for swinging movement about an axis which extends substantially parallel with the longitudinally extending direction of the rail. The lever has a cam associated therewith. A spring-receiver structure is mounted on the tie and positioned on the opposite side of the axis from the rail, and an elongated plate-like spring extends between the spring-receiver structure and the rail. The spring has one end supported on the spring-receiver structure and the other end supported on a flange of the rail. The spring is disposed below the lever and positioned so that the cam is adapted for engaging a central portion of the spring, whereby rotation of the lever causes the cam to engage the spring and resiliently deflect same downwardly to thereby press the rail securely against the tie.

5 Claims, 14 Drawing Figures

RAIL FASTENING APPARATUS

FIELD OF THE INVENTION

This invention relates to apparatus for fastening rails to concrete ties or track beds.

BACKGROUND OF THE INVENTION

In fastening rails with fastening apparatus employing springs or other metal means, dog or screws spikes or bolts and nuts have conventionally been used. With such rail fastening apparatus, it has been necessary to regularly watch for loosening resulting from the vertical and transverse motion of the rails as caused by the load by rolling stock. It has also been necessary to oil the dog or screw spikes or bolts and nuts at some months' intervals to prevent their rusting or clogging with splashed mud. All this has necessitated an enormous amount of time and labor in the maintenance of railroad tracks.

This invention has obviated the aforementioned shortcomings, as described hereunder by reference to the accompanying drawings.

DETAILED DESCRIPTION

Figure 1:
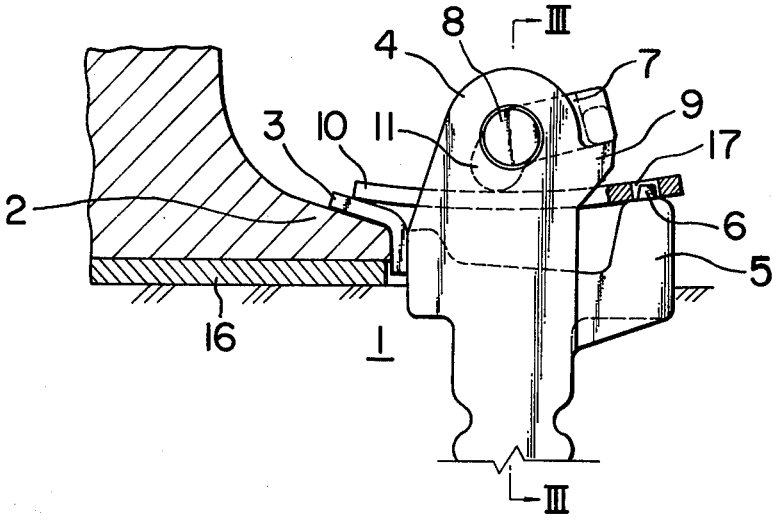
FIG. 1 is a front view of a first embodiment of this invention.
Figure 2:
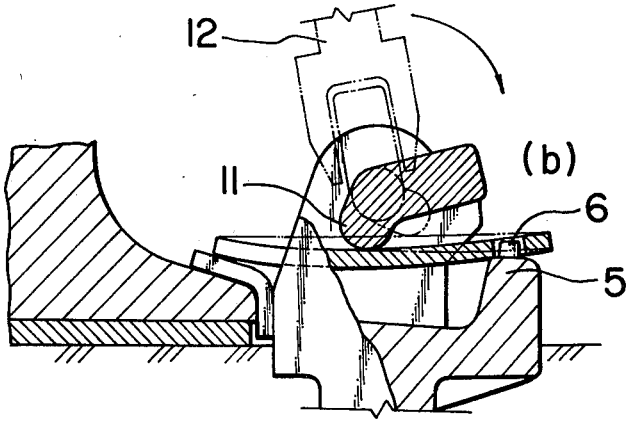
FIG. 2 is a partially cross-sectional view showing the conditions before and after the cam lever is turned.
Figure 3:
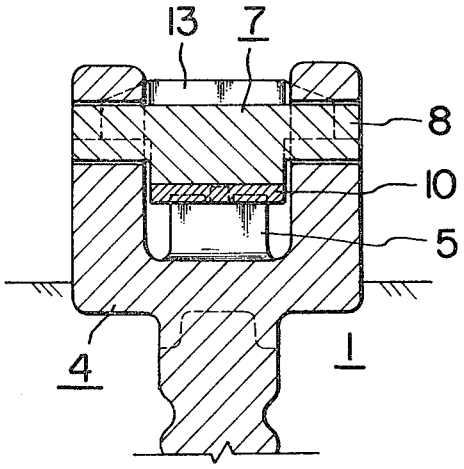
FIG. 3 is a cross-sectional view taken along the line III—III of FIG. 1.
Figure 4:
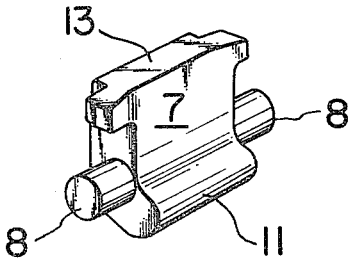
FIG. 4 is a perspective view of the cam lever.
Figure 5:
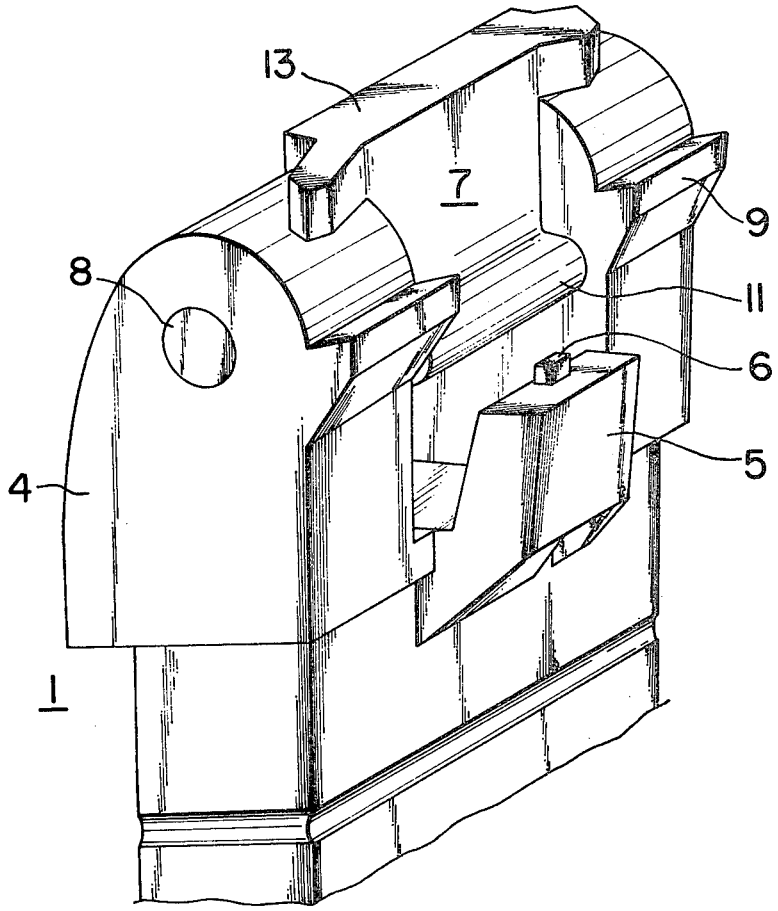
FIG. 5 is a perspective view of the embodiment shown in FIG. 1, but the plate spring is not yet pressed.

A first embodiment of this invention is shown in FIGS. 1 through 5. In order that a rail flange 2 is held, through an insulating material 3, close to such a tie 1 as made of prestressed or reinforced concrete, the leg of a steel support 4 is buried in said tie. The steel support 4 has a plate spring receiver 5 extending outwardly and upwardly, with a plate spring engaging projection 6 formed at the top thereof. The upper projection of the steel support 4 pivotally carries a rotation shaft 8 of a cam lever 7, and also has a cam lever stopper 9. As illustrated in FIG. 4, the cam lever 7 comprises a cam section 11 having a rounded exterior cam surface that directly presses a plate spring 10 and a T-shaped top end 13 with which an end of an operating rod 12 for rotating the cam lever 7 engages.

Figure 6:
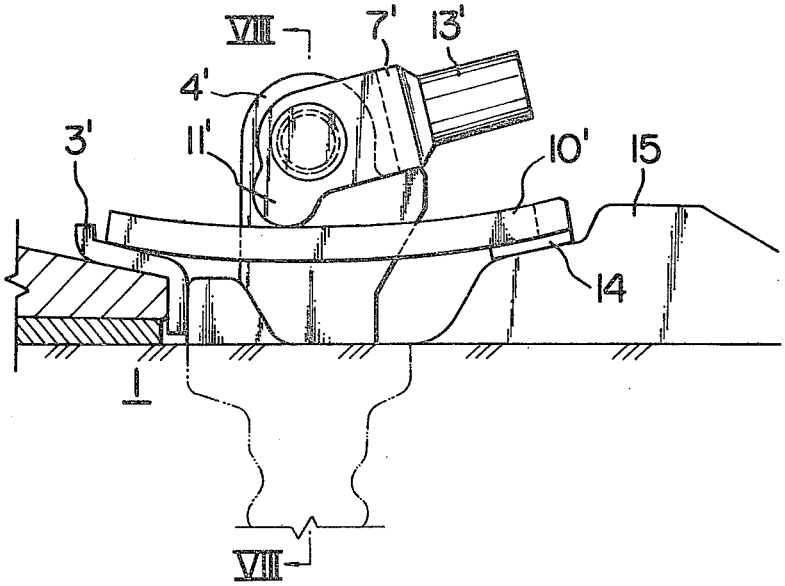
FIG. 6 is a front view of a second embodiment.
Figure 7:
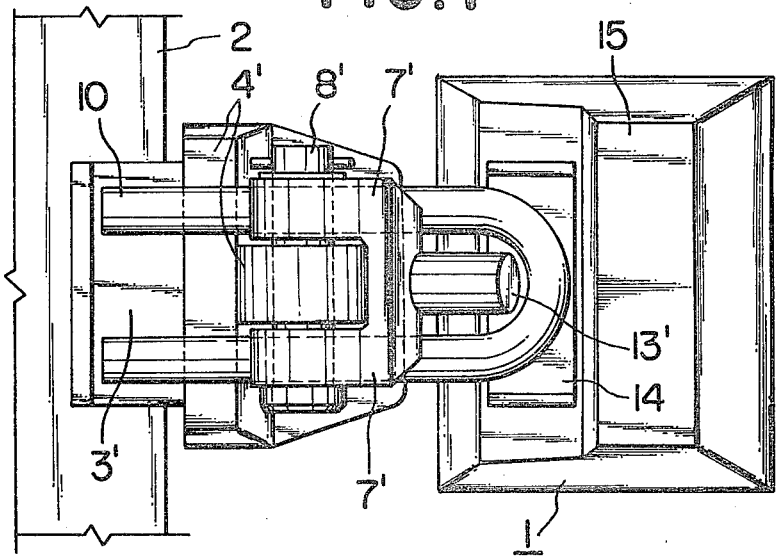
FIG. 7 is a plan view of the same embodiment.
Figure 8:
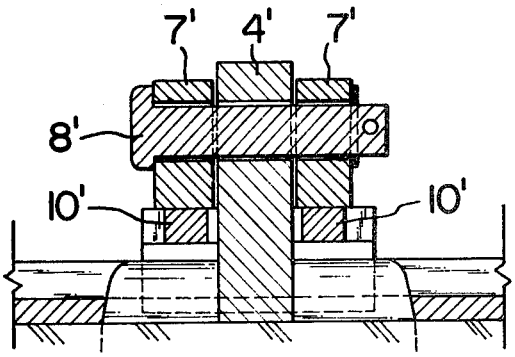
FIG. 8 is a cross-sectional view taken along the line VIII—VIII of FIG. 6.
Figure 9:
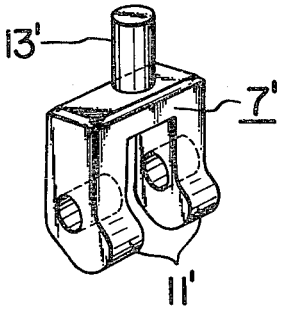
FIG. 9 is a perspective view of the cam lever of the second embodiment.
Figure 10:
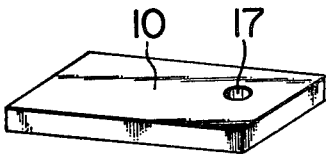
FIGS. 10 and 12 illustrate plate springs of various designs.
Figure 11:
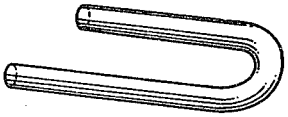
Figure 12:
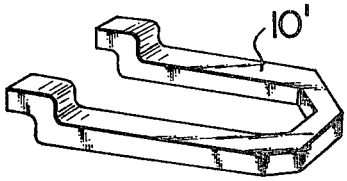

In a second embodiment shown in FIGS. 6 through 9, the cam section 11′ of the cam lever 7′ is divided into two branches as shown in FIGS. 7 through 9. In this case, the plate spring 10′ is U-shaped. Instead of forming the plate spring receiver 5 on the steel support 1 as in FIG. 1, a plate spring engaging projection 15 is formed on the tie 1, and the plate spring 10′ may be received thereon with an insulating material 14 therebetween, as shown in FIG. 6. The cam section 11′ of the cam lever 7′ has a rounded exterior cam surface which may be formed as either a circular surface or an Archimedean surface that applied increasingly greater force onto the spring 10′. Further, the plate spring 10′ may, of course, be shaped like a bar, as shown in FIGS. 11 and 12.

OPERATION

The rail laying operation using the rail fastening apparatus according to this invention will be briefly described.

The legs of two steel supports 4 are buried in a tie 1 made of prestressed or reinforced concrete so that the inner surfaces of the two steel supports 4 are spaced at a distance equal to the width of the rail flange plus the thickness of insulating materials 3 on both sides. A rubber pad or tie plate 16 is placed in a given position between the two steel supports 4, then a rail is laid thereon. A plate spring 10 is passed under the cam lever 7 pivotally carried by the steel support 4, and held between the upper surface of the rail flange, through the insulating material 3, and the spring reciver 5 formed on the steel support 4. An engaging hole 17 perforated in the plate spring 10 engages with the projection 6 on the spring receiver 5 to keep the spring 10 fixed. Next, an end of the operating rod 12 is engaged with the T-shaped top end 13 of the cam lever. By turning the operating rod 12, the cam lever 7 is shifted from position (a) to position (b) in FIG. 2, whereupon the cam section 11 of the cam lever 7 depresses the plate spring 10. Through the insulating material 3, the depressed plate spring 10 presses the rail flange 2 against the tie 1, with the rubber pad or tie plate 16 therebetween, thereby elastically fastening the rail to the tie. When the cam lever 7 stops at position (b) by coming into contact with the stopper 9, the operating rod 12 is disengaged to complete the operation. By thus turning the cam section 11 of the cam lever 7 to position (b) which is slightly beyond the dead center, the cam section 11 is prevented from reversing and, therefore, exerts an unchanged pressing force even when it is subjected to vibrations caused by the passing rolling stock.

As evident from the above description, this invention utterly dispenses with dog or screw spikes or bolts and nuts. Accordingly, it eliminates the need to regularly watch for their loosening that has conventionally been caused from time to time by the vibration of the rail. It is an important safety advantage to the track maintenance men. Further, there is no need to provide oiling at some months' intervals, which has heretofore been necessary for the prevention of their rusting or clogging.

The cam lever and spring according to the above-described second embodiment (FIGS. 6–9) operates in the same manner as described above. In addition, this second embodiment insures more stable rail fastening and, therefore, higher safety, because the cam lever exerts its pressing force through two cams and the plate spring 10′ is supported at three points.

As understood from the above, this invention provides a highly economic and safe rail fastening apparatus that is simple in construction, makes the rail laying operation easy, secures the rails in position firmly, reduces the labor used in track maintenance, and eliminates the expenses for the rust and clogging preventive oiling.

The pressure to press the rail flange 2 is changed by changing the thickness of the insulating material 14.

The position of the rail is changed by changing the thickness of a perpendicular portion of the insulating material 3 which is located between rail flange 2 and the steel support 4.

MODIFICATION

Figure 13:
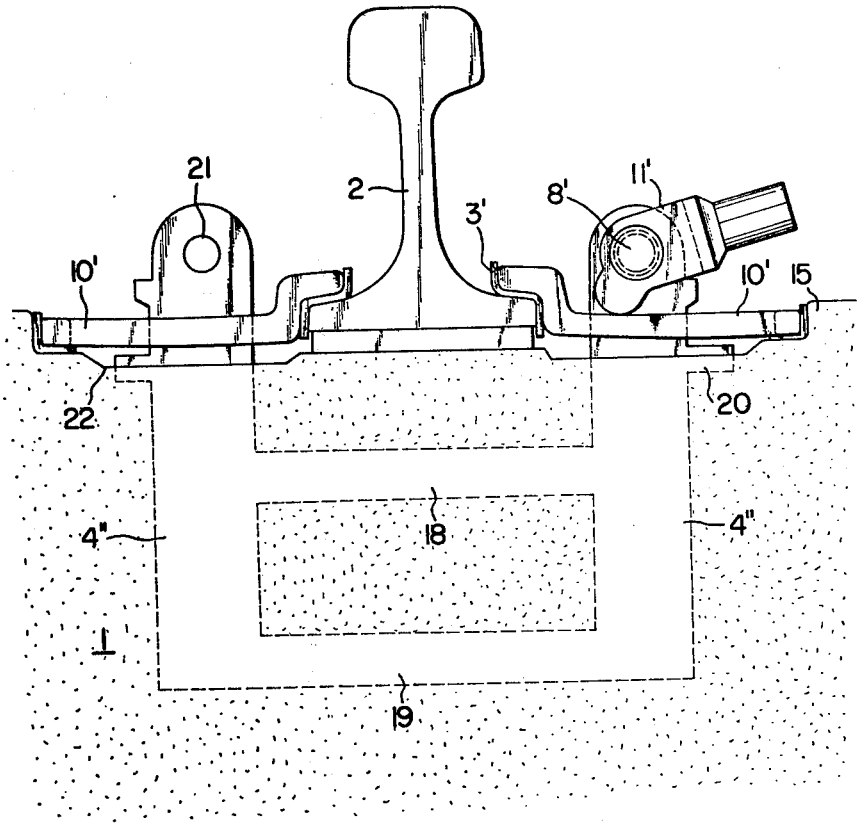
FIG. 13 is a front view of another embodiment of the steel support.
Figure 14:
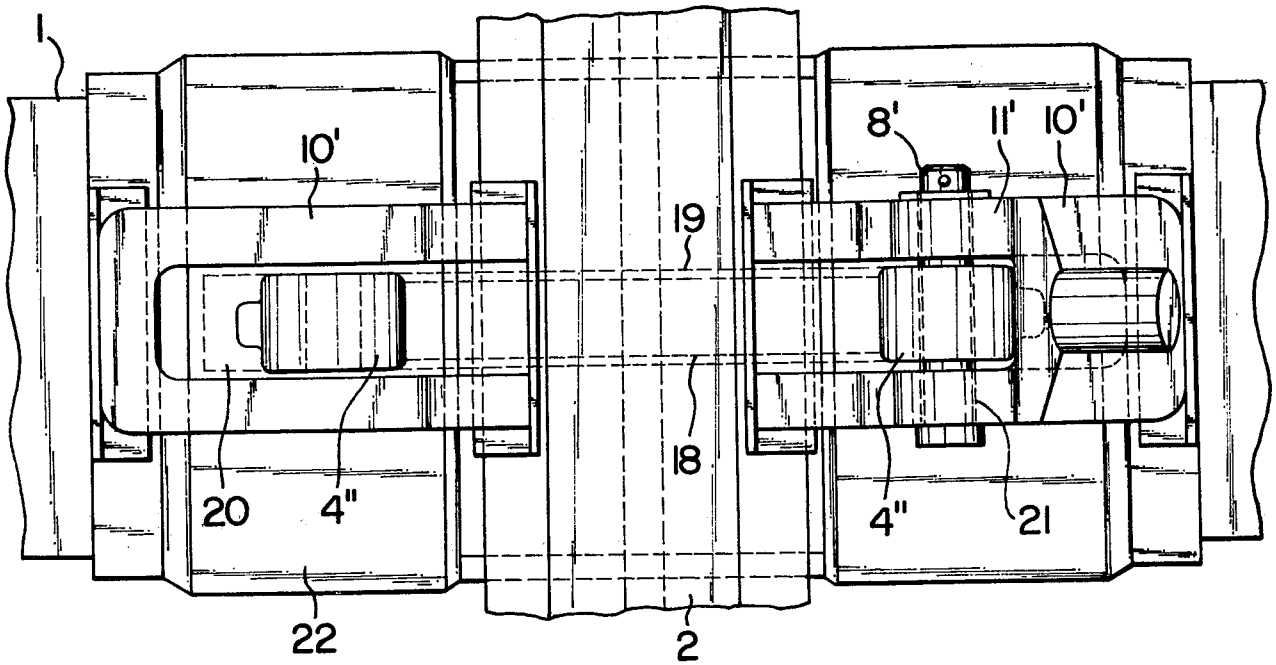
FIG. 14 is a plan view of FIG. 13.

FIGS. 13 and 14 illustrate another embodiment of the invention wherein the legs of a pair of steel supports 4'' are buried in the tie 1 on opposite sides of the rail 2. This pair of steel supports 4'' is interconnected as an integral unit by upper and lower reinforcing rods 18 and 19 which are buried in the tie 1 and pass perpendicularly beneath the longitudinally extending direction of the rail 2. Each steel support 4'' has a flanged portion 20 formed thereon and projecting sidewardly therefrom, which flange portion is disposed adjacent the upper surface 22 of the tie and is positioned so as to be partially buried in the tie, whereby the upper tie surface 22 is positioned substantially midway between the upper and lower surfaces of the flanged portion 20. These steel supports 4'' each extend upwardly above the flange portion 20 and is provided with hole 21 in the upper end thereof, which hole rotatably supports a cam shaft 8' as described above. This cam shaft cooperates, in the manner illustrated in FIGS. 7–9, with a camming lever 11' for pressing against a plate spring 10', which spring coacts between the projection 15 and the rail 2 in the same manner as illustrated in the previously described embodiments.

In FIGS. 13 and 14, a cam lever 11' is illustrated in association with only the rightward support 4'' for purposes of illustration, it being understood that a further identical camming lever will also be associated with the leftward support 4''.

The operation of the embodiment illustrated in FIGS. 13 and 14 is identical to the operation of the other embodiments in that the fastening apparatus is effective for clamping the opposite sides of the rail to maintain same securely against the tie. However, by integrally joining the opposed pair of supports 4'' by the reinforcing rods 18 and 19 which are positioned under the rail and buried in the tie, these reinforcing rods 18 and 19 effectively react in opposite directions in that one rod is effectively loaded in tension and the other in compression when a load is imposed on the rail, as due to a train passing thereover. This load as imposed on the rail by the train results in a sideward or transverse pressure being imposed on the steel support 4'' which tend to deflect same outwardly, which transverse pressure is effectively transmitted to the tie by the flange portion 20. This results in the upper reinforcing rod 18 resisting the outwardly directed tension loads, whereas the lower reinforcing rod 19 resists the inwardly directed compression loads. These rods thus cause the cooperative pair of steel supports 4'' as located on opposite sides of the rail to react cooperatively as a single unit to thus minimize the transverse pressures which are imposed on the tie, thereby preventing breakage of the tie and resulting in substantial improvement in the endurance of the tie.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a rail fastening apparatus for cooperation with a rail which is supported on and extends transversely across a tie, said fastening apparatus including a steel support positioned adjacent one side of the rail and having a lower portion which is fixed to the tie and an upper portion which projects upwardly above the tie, cam means pivotally supported on said upper portion for swinging movement about an axis which extends substantially parallel with the longitudinally extending direction of the rail, spring-receiver means mounted on said tie and positioned on the opposite side of said axis from said rail, and elongated plate-like spring means extending between said spring-receiver means and said rail, said spring means having one end thereof supported on said spring-receiver means and the other end thereof supported on a flange of the rail, said spring means being disposed below said cam means and positioned so that said cam means is adapted for engaging a central portion of said spring means, whereby rotation of said cam means causes it to engage said spring means and resiliently deflect same downwardly to thereby press the rail securely against the tie, comprising the improvement wherein said cam means includes a radially projecting cam portion having a rounded smoothly curved exterior cam surface engageable with said spring means, said cam surface being eccentrically positioned relative to said axis and having a profile which causes the cam means to rotate through an over-center position when being pivotally moved relative to said spring means between a released position and a holding position, said cam portion when in said holding position being urged by said spring means to rotate in a direction away from said over-center position, and stationary stop means engageable with said cam means when the latter is in said holding position for preventing rotation of said cam means in said direction.

2. An apparatus according to claim 1, wherein said spring-receiver means forms an integral part of the steel support.

3. An apparatus according to claim 1, wherein said cam means comprises a one-piece cam member having an intermediate bearing portion positioned above said spring means and rotatably supported on said support, said cam member including a first portion which projects radially of said bearing portion toward said spring means, said first portion having said curved exterior cam surface formed on the radially outer end thereof, and said cam member including a second portion projecting radially outwardly from said bearing portion, said second portion being substantially angularly spaced from said first portion and being adapted to have an elongated lever engaged therewith for manual rotation of said cam member.

4. Apparatus according to claim 3, wherein the first and second portions of said cam member are substantially within the same radial plane but are angularly displaced so as to be on approximately opposite sides of the intermediate bearing portion, and wherein said intermediate bearing portion includes a pair of bearing hubs which project axially in opposite directions away from said radial plane for rotatable engagement with said support.

5. Apparatus according to claim 3, wherein said cam member includes a U-shaped part having a base and a pair of spaced projecting legs, said base defining said bearing portion, and said legs being identical and defining said first portion, each of said legs having said rounded exterior cam surface formed on the free end thereof, and said second portion of said cam member comprising a rodlike projection which is fixed centrally to said base and projects radially outwardly therefrom in a direction substantially opposite from said legs.

* * * * *